US008681070B2

(12) United States Patent
DiNallo et al.

(10) Patent No.: US 8,681,070 B2
(45) Date of Patent: Mar. 25, 2014

(54) CO-AXIAL QUADRIFILAR ANTENNA

(75) Inventors: Carlo DiNallo, Plantation, FL (US); Stanislav Licul, Blacksburg, VA (US); Nathan Cummings, Gaithersburg, MD (US)

(73) Assignee: Maxtena, Rockville, MD (US)

( * ) Notice: Subject to any disclaimer, the term of this patent is extended or adjusted under 35 U.S.C. 154(b) by 199 days.

(21) Appl. No.: 13/297,854

(22) Filed: Nov. 16, 2011

(65) Prior Publication Data

US 2012/0280884 A1 Nov. 8, 2012

Related U.S. Application Data

(63) Continuation-in-part of application No. 13/103,084, filed on May 8, 2011.

(51) Int. Cl.
*H01Q 1/36* (2006.01)

(52) U.S. Cl.
USPC ..... 343/895; 343/853; 343/876

(58) Field of Classification Search
USPC ..... 343/895, 853, 876
See application file for complete search history.

(56) References Cited

U.S. PATENT DOCUMENTS

| | | | | |
|---|---|---|---|---|
| 5,909,196 | A * | 6/1999 | O'Neill, Jr. | 343/895 |
| 5,986,619 | A * | 11/1999 | Grybos et al. | 343/895 |
| 2008/0094307 | A1 * | 4/2008 | Cowles | 343/895 |

* cited by examiner

*Primary Examiner* — Dieu H Duong

(57) ABSTRACT

Antennas that include an inner set of four helical antenna elements and a co-axially arranged outer set of four helical antenna elements. The helical winding directions of the two sets of elements may have the same handedness or opposite handedness. Certain embodiments provide for switch handedness of circularly polarized radiation of the antennas and certain embodiments provide for shifting the directivity of the antenna pattern in polar angle. Systems in which the antennas are used and methods of use are also taught.

8 Claims, 6 Drawing Sheets

CO-AXIAL QUADRIFILAR ANTENNA

RELATED APPLICATION DATA

This application is a Continuation-In-Part (CIP) of U.S. Ser. No. 13/103,084 filed May 8, 2011.

FIELD OF THE INVENTION

The present invention relates generally to wireless communication systems.

BACKGROUND

As modern society infrastructure and various operations (e.g., civilian, military) increasingly come to depend on ubiquitous always-on information system connectivity and intelligence antennas have an important role to play in addressing such issues.

Low earth orbiting satellites provide a means for maintaining connections to information systems. Low earth orbiting satellites move relatively rapidly from one horizon to the opposite horizon as viewed from a terrestrial observation point. To maintain connectivity with such satellites, it would be desirable to have antenna systems that can sustain communications over a wide range of polar angles. There are mechanically steered antenna systems that track satellites, but these suffer certain disadvantages such as size and weight, mechanical wear and inability to switch from pointing from one target (e.g., satellite) to another in millisecond or less periods, so as to maintain communications when one satellite passes beyond the horizon.

Additionally it would be desirable to have a single antenna system that can operate with either Left Hand Circularly Polarized (LHCP) radio waves or Right Hand Circularly Polarized (RHCP) radio waves, so that communications can be maintained in either case without the provision of two separate antenna systems, which would add bulk and cost which is undesirable.

There are certain phased array patch antenna systems that are capable of both LHCP and RHCP operation but unfortunately the gain pattern of such patch antennas is weak at high polar angles, so maintaining communication with satellites near the horizon is problematic.

BRIEF DESCRIPTION OF THE FIGURES

The accompanying figures where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
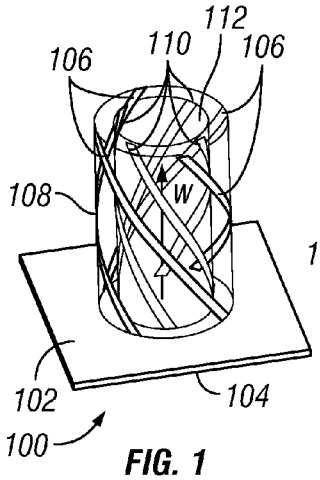
FIG. 1 is an x-ray perspective view of a dual, co-axial quadrifilar antenna in which the two co-axial quadrifilars are wound in the same (left-handed) direction.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and apparatus components related to wireless communication. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

It will be appreciated that embodiments of the invention described herein may be comprised of one or more conventional processors and unique stored program instructions that control the one or more processors to implement, in conjunction with certain non-processor circuits, some, most, or all of the functions of wireless communication described herein. The non-processor circuits may include, but are not limited to, a radio receiver, a radio transmitter, signal drivers, clock circuits, power source circuits, and user input devices. As such, these functions may be interpreted as steps of a method to perform wireless communication. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Figure 2:
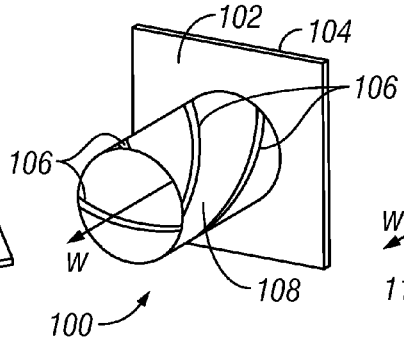
FIG. 2 is a perspective view of an outer quadrifilar of the antenna shown in FIG. 1.
Figure 3:
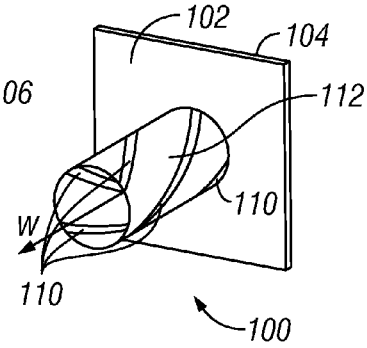
FIG. 3 is a perspective view of an inner quadrifilar of the antenna shown in FIG. 1.

FIG. 1 is an x-ray perspective view of a dual, co-axial, quadrifilar antenna 100 in which the two co-axial quadriflars are wound in the same (left-handed) direction. FIG. 2 is a perspective view just showing an outer quadrifilar of the antenna shown in FIG. 1 and FIG. 3 is a perspective view just showing an inner quadrifilar of the antenna shown in FIG. 1. Referring to FIGS. 1-3, the antenna 100 includes a printed circuit board (PCB) base 102 that includes a ground plane 104. The antenna 100 includes a first set of four filar elements 106 disposed on an outer cylindrical support 108 and a second set of four filar elements 110 disposed on an inner cylindrical support 112. The cylindrical supports 108, 112 are suitably dielectric. Alternatively self supporting helical elements are used. The elements in the sets of four elements 106, 110 and in other embodiments described herein below preferably have a nominal effective electrical length when operating of about ¼λ. The actual effective electrical length when operating is suitably between 0.2λ and 0.3λ. The effective electrical length includes the radius of the cylindrical supports, because the currents oscillate between opposite elements crossing through the PCB base 102. Having a nominal electrical length of about ¼λ as opposed to ¾λ or longer allows the inner 110 and outer 106 antenna elements to operate without disrupting each other despite their close proximity, and also makes for a compact antenna. A longitudinal axis of the antenna 100 labeled 'w' is also shown in FIGS. 1-3. The winding direction of the antenna elements 106, 110 is left-hand in the sense that if the fingers of a left hand are wrapped around the axis 'w' with the thumb pointing in the direction of 'w' (away from the ground plane 104), as one proceeds in the direction of 'w' the elements 106, 110 wrap in the same direction as the fingers of the left hand.

By properly sizing the elements 106 disposed on the outer support 108, relative to the elements 110 disposed on the inner support 112 and relative to the drive frequency of the antenna, and by selectively coupling bottom ends of the elements 106 disposed on the outer support 108 to one or more loads (e.g., a capacitive load), the directivity pattern of the antenna can be altered. In particular the directivity at high polar angles can be strengthened. Antennas for satellite communication often suffer from poor gain at high polar angles. This feature enables improved maintenance of signal quality with satellites closer to the horizon. Switching the bottom ends of the elements 106 from an open condition to being coupled to capacitive loads enables parasitic coupling of energy from the inner elements 110 to the outer elements 106. The capacitive loads effectively shorten the electrical length of the outer elements 106, however the outer elements 106 are made longer so that, even when coupled to the capacitive loads, they have an effective electrical length that is longer than the inner elements 110, preferably between 5% and 20% longer. Beyond about 20% higher modes could be excited, which is not the desired effect in this case. Because the outer elements 106 have longer effective electrical lengths there will be a phase difference between the excitation signal coming from the inner elements 110 and the oscillation excited in the outer elements 106. This phase difference should be different from the propagation phase delay between the inner elements 110 and the outer elements, so that it creates a focusing effect along the radial direction for improved low elevation directivity. Choosing the relative electrical lengths according to the foregoing guidance, allows the change in the directivity pattern to be attained when the antenna is operated with switch loads as mentioned above and more fully described below. The capacitive loads on the outer elements 106 are not in the signal pathway used to feed the antenna 100 and therefore so-called 'hot-switching' in which the capacitive loads are coupled and decoupled without interrupting the flow of signals to and from the antenna is possible. Thus, advantageously, communication channels can be maintained while changing the directivity pattern. For example communications with a satellite moving toward the horizon can be maintained without interruption. Unlike prior art approaches it is unnecessary to provide a mechanical arrangement for pointing the antenna in order to maintain communications.

Figure 4:
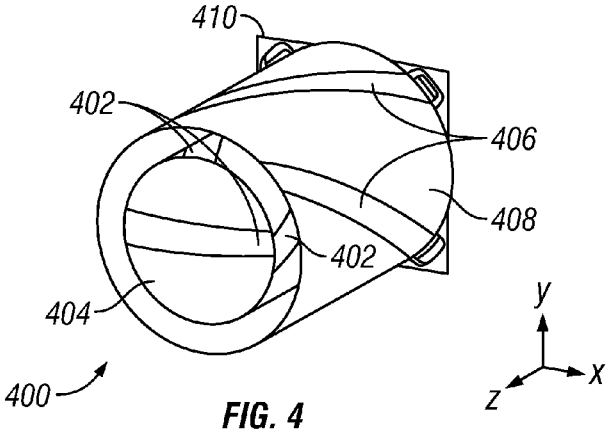
FIG. 4 is a perspective view of a dual, co-axial quadrifilar antenna in which the two co-axial quadrifilars are wound in opposite directions.
Figure 5:
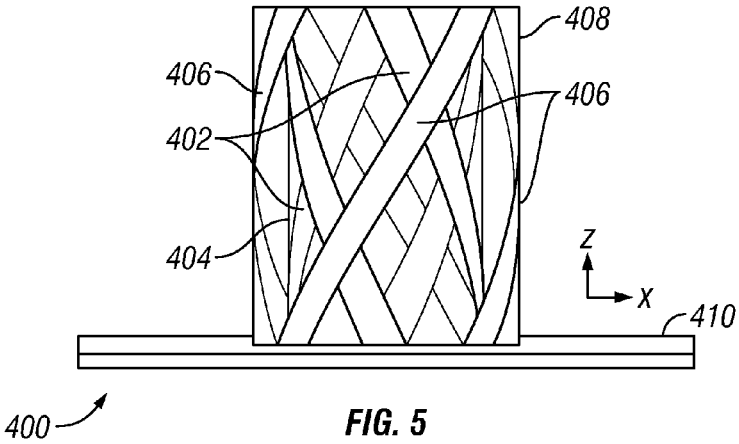
FIG. 5 is an x-ray elevation view of the antenna shown in FIG. 4.

FIG. 4 is a perspective view of a view of a dual, co-axial quadrifilar antenna 400 in which the two co-axial quadrifilars are wound in opposite directions and FIG. 5 is an x-ray elevation view of the antenna shown 400 in FIG. 4. The antenna 400 includes a first set of four elements 402 (a quadrifilar set) disposed on an inner cylindrical support 404 and a second set of four elements 406 (a quadrifilar set) disposed on an outer cylindrical support 408. The cylindrical supports 404, 408 are supported on a PCB 410. The first set of four elements 402 are wound in the left-handed sense, while the second set of four elements 406 are wound in the right-handed sense. The two quadrifilar sets of elements allow the antenna 100 to communicate with Right Hand Circularly Polarized (RHCP) or Left Hand Circularly Polarized (LHCP) waves. Having the two quadrifilar sets of elements concentrically arranged in the manner shown and described, allows for a space efficient antenna design, that is substantially smaller than competitive designs. In certain embodiments multiple antennas 400 are used in a phased array. In this case the same phase shifting circuitry can be used for both LHCP and RHCP communications thus saving expense that dual circuitry would entail.

Figure 6:
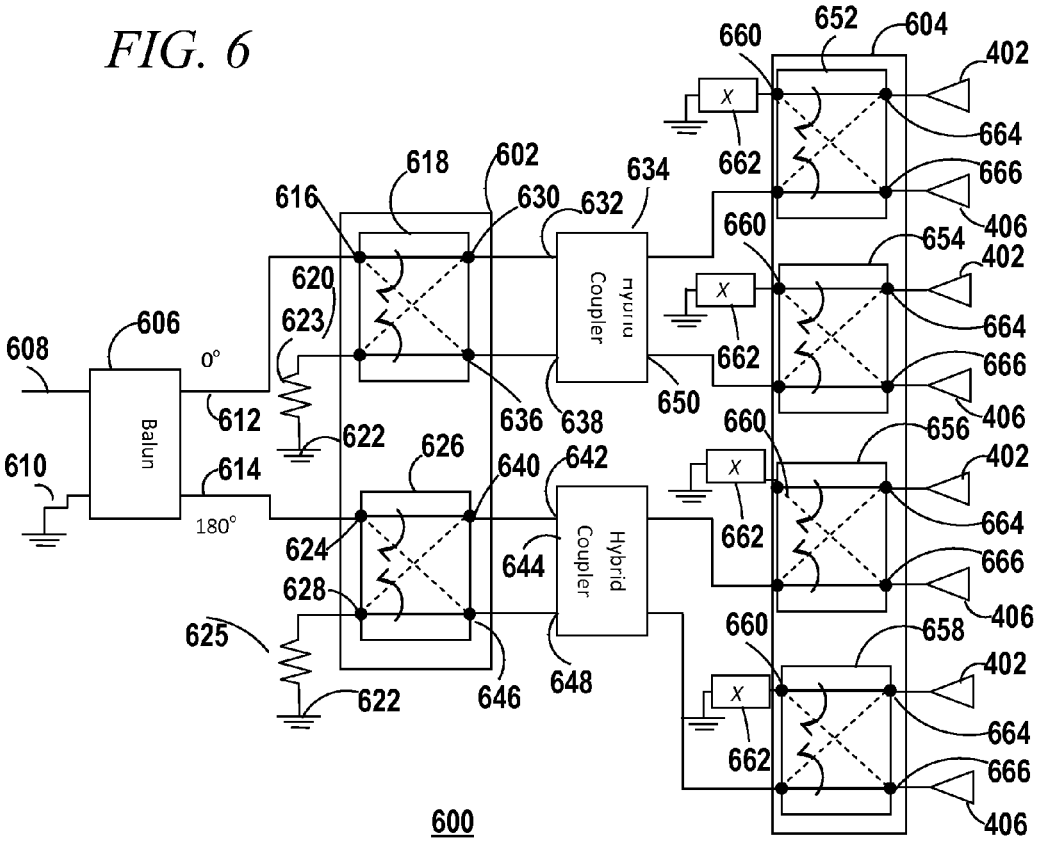
FIG. 6 is a block diagram of an antenna feed network with a first layer of switches for switching a sense of phase rotation of signals fed to a dual quadrifilar antenna and a second layer of switches for selectively driving one of the two quadrifilars in the dual quadrifilar antenna.

FIG. 6 is a block diagram of an antenna feed network 600 with a first layer of switches 602 for switching a sense of phase rotation of signals fed to a dual quadrifilar antenna and a second layer of switches 604 for selectively driving one of the two quadrifilars in the dual quadrifilar antenna. Starting at the left side of FIG. 6, the antenna feed network 600 comprises a balun 606 comprising a balun input port 608 and an input side (unbalanced side) ground port 610. On its output side (balanced side) the balun 606 comprises a 0° output port 612 and a 180° output port 614. The 0° output port 612 is coupled to a first input port 616 of a first 2 by 2 switch matrix 618. A second input port 620 of the first 2 by 2 switch matrix 618 is coupled to a system ground 622 through a first 50 Ohm load resistor 623. The 2 by 2 switch matrix 618 is a type of switch network. In certain practical implementations a predetermined terminating impedance, e.g., 50 Ohm resistance is integrated into a device embodying the 2 by 2 switch matrix 618 and other such devices described below. In such cases a separate 50 Ohm load resistor 623 is not needed. The 2 by 2 switch matrixes described herein may be embodied in commercially available "absorptive switches". The 180° output port 614 of the balun 606 is coupled to a first input port 624 of a second 2 by 2 switch matrix 626. A second input port 628 of the second 2 by 2 switch matrix 626 is coupled to the system ground 622 through a second 50 Ohm load resistor 625.

A first output port 630 of the first 2 by 2 switch matrix 618 is coupled to a first input port 632 of a first 90° hybrid coupler 634. A second output port 636 of the first 2 by 2 switch matrix 618 is coupled to a second input port 638 of the first 90° degree hybrid coupler 634. The first 2 by 2 switch matrix 618 is operative to selectively couple the first input port 632 of the first 90° hybrid coupler to the 0° output port 612 of the balun 606 or to the first load resistor 623 and is also operative to selectively couple the second input port 638 to the 0° output port 612 of the balun 606 or to the load resistor 623. Note that only one of the input side ports 632, 638 of the 90° hybrid coupler 634 will be coupled to the 0° output port 612 of the balun 606. Whichever is not will be coupled to the load resistor 623.

A first output port 640 of the second 2 by 2 switch matrix 626 is coupled to a first input port 642 of a second 90° hybrid coupler 644. A second output port 646 of the second 2 by 2 switch matrix 626 is coupled to a second input port 648 of the second 90° degree hybrid coupler 644. The second 2 by 2 switch matrix 626 is operative to selectively couple the first input port 642 of the second 90° hybrid coupler 644 to the 180° output port 614 of the balun 606 or the second load resistor 625 and is also operative to selectively couple the second input port 648 of the second 90° hybrid coupler 644 to the 180° output port 614 of the balun 606 or the second load resistor 625.

The first 90° hybrid coupler 634 includes a 0° output port 648 and a 90° output port 650. The second layer of switches 604 includes a third 2 by 2 switch matrix 652, a fourth 2 by 2 switch matrix 654, a fifth 2 by 2 switch matrix 656 and a sixth 2 by 2 switch matrix 658. Each of 2 by 2 switch matrices 652, 654, 656, 658 of the second layer of switches 604 includes a first input port 660, coupled to a terminating impedance 662. Each of the foregoing 2 by 2 switch matrices 652, 654, 656, 658 includes a first output port 664 coupled to one of the first set of four quadrifilar elements 402 and a second output port 666 coupled to one of the second set of four quadrfilar elements 406. Connecting to the elements 402, 406 of the antenna depicted in FIG. 4 and described above is one embodiment. Alternatively the feed network 600 can be used with an antenna having a design that departs from what is shown in FIG. 4. In order to correlate the relative phasing provided to the respective elements 402, 406 with the physical arrangement of those elements 402, 406 it should be noted that elements 402, 406 are arranged such that proceeding from top to bottom in FIG. 6 is equivalent to proceeding in a counterclockwise (CCW) direction in FIG. 4. Thus the top element 402 in FIG. 6 is one position in the clockwise (CW) direction in FIG. 4 from the second from the top element as shown in FIG. 6.

Figure 7:
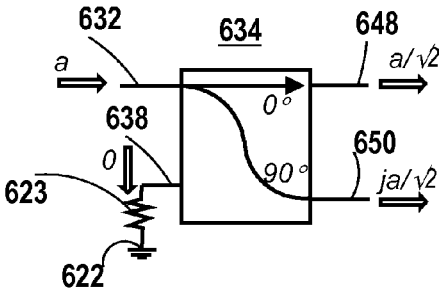
FIGS. 7-8 illustrate how 90° hybrids are used in the antenna feed networks shown in FIG. 6 and FIG. 11.
Figure 8:
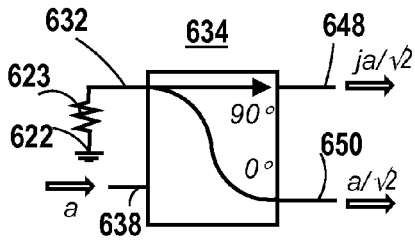

FIGS. 7-8 illustrate how 90° hybrids are used in the antenna feed networks shown in FIG. 6 and FIG. 11 described below. FIGS. 7-8 are labeled using the reference numerals of the first 90° hybrid 634. In the context of FIG. 6, FIGS. 7-8 illustrate how the first 2 by 2 switch matrix 618 is used to alter the relative phases of signals emanating from the first 90° hybrid 634. FIG. 7 shows the case that the switch matrix 618 is configured to couple the 0° output 612 of the balun 606 to the first signal input 632 of the first 90° hybrid 634 and to couple the second input port 638 of the first 90° hybrid 634 to the first load resistor 623. In this case the 0° output port 648 of the first 90° hybrid 634 outputs a signal at 0° and the 90° output port 650 outputs a signal at 90°.

FIG. 8 shows the case that the first 2 by 2 switch matrix 618 is configured to couple the 0° output port 612 of the balun 606 to the second input port 638 of the first 90° hybrid 634 and to couple the first signal input 632 of the first 90° hybrid 634 to the first load resistor 623. In this case the 0° output port 648 of the first 90° hybrid 634 outputs a signal at 90° and the 90°output port 650 outputs a signal at 0°, i.e., the phases are reversed. The second 2 by 2 switch network 626 works with the second 90° hybrid 644 in the same manner.

Thus by setting the 2 by 2 switch matrices 618, 626 in the first layer of switches 602 to provide input signals to the 90° hybrids 634, 644 as shown in FIG. 7, one attains a phase that increases monotonically in 90° steps as one proceeds counterclockwise (when looking down at the antenna 400) from element to element of each of the sets of four elements 402, 406. On the other hand by setting the 2 by 2 switch matrices 618, 626 to provide input signals to the 90° hybrids 634, 644 as shown in FIG. 8, one attains a phase that increase monotonically in 90° steps as one proceeds clockwise from element to element of each of the sets of four elements 402, 406.

Recall that the inner set of four quadrifilar elements 402 is wound in left-handed sense and the outer set of four quadrifilar elements 406 is wound in a right-handed sense. The 2 by 2 switch matrices 652, 654, 656, 658 in the second switch layer 652 are used to select one of the sets of quadrifilar elements 406 to be coupled to signals received from the hybrids 634, 644 while the other is coupled to terminating impedances (loads) 662. When the second switch layer 652 is set to apply signals to the outer right-handed set of elements 406, the first switch layer 602 is set to establish phase increasing in the counterclockwise direction. On the other hand, when the second switch layer 652 is set to apply signals to inner left-handed set of elements 402, the first switch layer 602 is set to establish phase increasing in the clockwise direction.

The term 'input' as used above designates ports towards the left side of blocks in FIG. 6 while the term 'output' as used above designates ports towards the right side of blocks in FIG. 6, however it is to be understood antenna feeding network 600 is bi-directional, i.e., it can be used for receiving and transmitting. In receiving the signal flow would be from right to left, so what had served as in input in receiving mode would now serve as an output.

Figure 9:
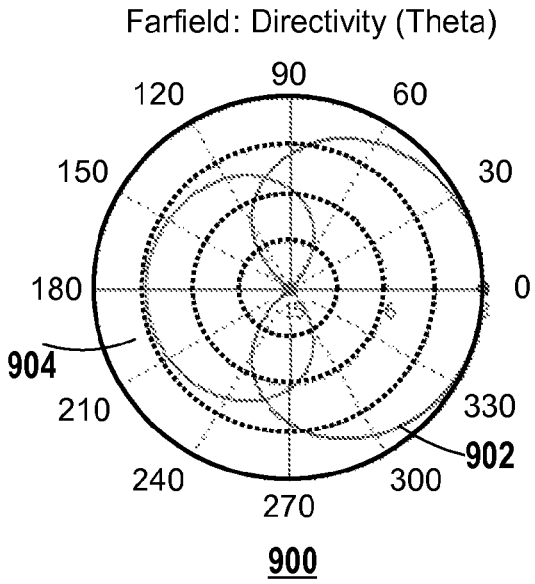
FIG. 9 is a polar graph with plots of directivity for Right Hand Circular Polarization (RHCP) and Left Hand Circular Polarization (LHCP) modes for an antenna of the type shown in FIGS. 4 and 5 when fed through a feed network of the type shown in FIG. 6 with the feed network configured for RHCP.
Figure 10:
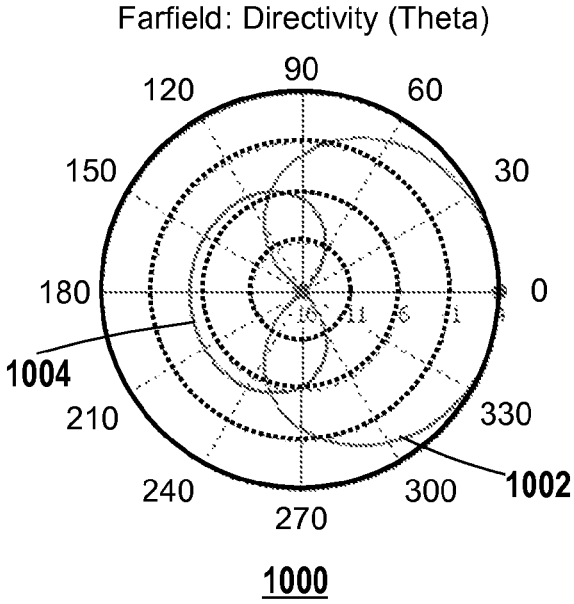
FIG. 10 is equivalent to FIG. 9 with the feed network configured for LHCP.

FIG. 9 is a polar graph 900 with plots of directivity for Right Hand Circular Polarization (RHCP) 902 and Left Hand Circular Polarization (LHCP) 904 modes for an antenna of the type shown in FIGS. 4 and 5 when fed through a feed network of the type shown in FIG. 6 with the feed network configured for RHCP. FIG. 10 is a graph 1000 equivalent to FIG. 9 with the feed network configured to LHCP. In FIG. 10 a first plot 1002 shows the directivity of the LHCP wave and a second plot 1004 shows the directivity of the RHCP wave. As shown the dominant gain can be changed from RHCP to LHCP. To configure the antenna 400 for sending or receiving RHCP signals, the 2 by 2 switch matrices 618, 626 in the first switch layer 602 are configured to couple signals to the 90° hybrid couplers 634, 644 as shown in FIG. 7, and the 2 by 2 switch matrices 652, 654, 656, 658 in the second switch layer 604 are configured to coupled signals to the right-handed outer set of elements 406. On the other hand, to configure the antenna 400 for sending or receiving LHCP signals the 2 by 2 switch matrices 618, 626 in the first switch layer 602 are configured to couple signals to the 90° hybrid couplers 634, 644 as shown in FIG. 8, and the 2 by 2 switch matrices 652, 654, 656, 658 in the second switch layer 604 are configured to couple signals to the left-handed inner set of elements 402.

Figure 11:
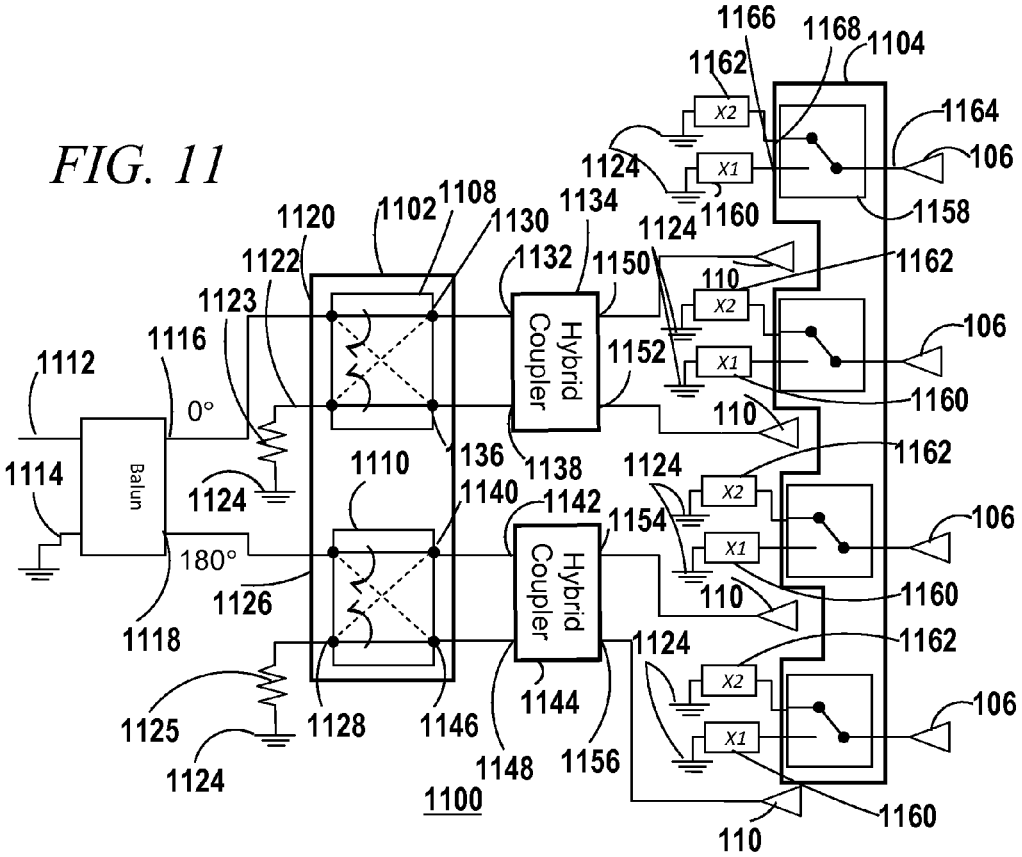
FIG. 11 is a block diagram of an antenna feed network with a first layer of switches for switching a sense of phase rotation of signals fed to a dual quadrifilar antenna and a second layer of switches for selectively loading elements of an outer quadrifilar of the dual quadrifilar with one of two loads.

FIG. 11 is a block diagram of an antenna feed network 1100 with a first layer of switches 1102 for switching a sense of phase rotation of signals fed to a dual quadrifilar antenna and a second layer of switches 1104 for selectively loading elements 106 of an outer quadrifilar of the dual quadrifilar with one of two sets of loads. The left side of the feed network 1100 has a structure which is the same as the left side of the feed network 600 shown in FIG. 6. Referring to FIG. 11 a balun 1106 includes an input port 1112, an input side grounded port 1114, a 0° output port 1116, and a 180° output port 1118. The 0° output port 1116 is coupled to a first input side port 1120 of a first 2 by 2 switch matrix 1108 of the first switch layer 1102. A second input side port 1122 of the first 2 by 2 switch matrix 1108 is coupled to a system ground 1124 through a first load resistor 1123. The 180° output port 1118 of the balun 1106 is coupled to a first input side port 1126 of a second 2 by 2 switch matrix 1110 of the first switch layer 1102. A second input side port 1128 of the second 2 by 2 switch matrix 1110 is coupled to the system ground 1124 through a second load resistor 1125.

A first output side port 1130 of the first 2 by 2 switch matrix 1108 is coupled to a first input port 1132 of a first 90° hybrid 1134. A second output side port 1136 of the first 2 by 2 switch matrix 1108 is coupled to a second input port 1138 of the first 90° hybrid 1134. Similarly, a first output side port 1140 of the second 2 by 2 switch matrix 1110 is coupled to a first input side port 1142 of a second 90° hybrid 1144. A second output side port 1146 of the second 2 by 2 switch matrix 1110 is coupled to a second input port 1148 of the second 90° hybrid 1144. A 0° output port 1150 and a 90° output port 1152 of the first 90° hybrid 1134 are coupled to a first and a second of the inner four quadrifilar elements 110. Similarly a 0° output port 1154 and a 90° output port 1156 of the second 90° hybrid 1144 are coupled to a third and a fourth of the inner four quadrifilar elements 110. In this context the quadrifilar elements are enumerated as taken in order when proceeding in a counterclockwise direction when looking down at the antenna. The starting element in the enumeration is arbitrary.

The outer four set of elements 106 of the antenna 100 (FIGS. 1-3) are shown at the right side of FIG. 11. Note that the outer elements 106 are not coupled by conductive signal pathways to the signal input for the feed network 1100 which is the input port 1112 of the balun. Rather, the outer four elements 106 receive RF signals that they will radiate by way of parasitic electromagnetic coupling from the inner four quadrifilar elements 110.

Note that while the elements 106, 110 of the antenna 100 shown in FIG. 1 are shown in FIG. 11, alternatively the feed network shown in FIG. 11 can be used with the antenna 400 shown in FIGS. 4-5 in which case the antenna elements 406, 402 of the antenna 400 would take the place of the antenna elements 106, 110 of the antenna 100. In both cases it would be the outer four quadrifilar elements 106, 406 that receive energy by way of parasitic electromagnetic coupling from the inner four quadrifilar elements 110, 402.

Whether or not the outer four quadrifilar elements 106 receive and re-radiate substantial signal energy is effected by how they are loaded at their bottom ends (ends located at PCB 102). The second switch layer 1104 includes four Single Pole Double Throw (SPDT) switches 1158 each of which serves to selectively couple one of the outer four quadrifilar elements 106 to one of two types terminating impedances 1160, 1162, which in turn are coupled to the system ground 1124. Each SPDT 1158 includes a first terminal 1164 coupled to one of the outer four quadrifilar elements 106, a second terminal 1166 coupled to a first type terminating impedance 1160 and a third terminal 1168 coupled to a second type of terminating impedance 1162. The first terminating impedance (e.g., 1160) which is used when it is desired to activate the outer quadrifilar elements 106 can for example comprise a capacitor having a capacitance chosen such that $1/(\omega C)<50$ ohm. Higher capacitive impedances are possible but may lead to antenna pattern degradation. The second terminating impedance 1162 can for example be an open circuit which has some small parasitic capacitance. Each SPDT 1158 is operative to selectively couple the first terminal 1164 which is coupled to one of the outer quadrifilar elements 106 to either the second terminal 1166 which is coupled to one of the first terminating impedances 1160 or to the third terminal 1168 which is coupled to one of the second terminating impedances 1162.

As described above with reference to FIG. 1 changing the loading of the outer elements 106 of the first antenna from the first type of terminating impedance 1160 to the second type of terminating impedance 1162 alters the directivity pattern of the antenna 100. By the provision of an antenna in which the directivity pattern can be altered an antenna that can more effectively operate over a broader range of polar angles is obtained. One type of application of the antenna 100 in which it is useful to be able to alter the gain pattern is for phased array applications. Phased array antennas are in principle intended to be able to sweep the peak in the array directivity pattern over a broad range of polar angle (as well as azimuth angle). However, if the pattern of the individual element (in the context of a phased array the entire antenna 100 is referred to as an 'element') drops off at high polar angles, the phased array will operate poorly at high polar angles.

Figure 12:
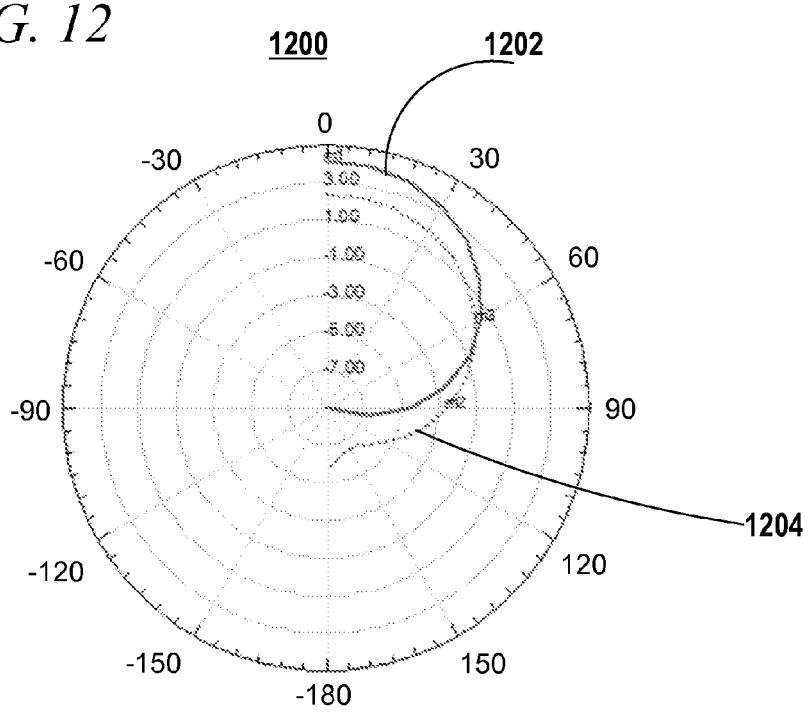
FIG. 12 shows a polar graph including directivity plots for the antenna shown in FIG. 1 with different loading of the outer elements.

FIG. 12 shows a polar graph 1200 including directivity plots 1202, 1204 for the antenna 100 with different loading of the outer elements. A first plot 1202 shows the directivity of the antenna 100 when the outer elements 106 are relatively inactive which occurs when the outer elements 106 are coupled to the second (high impedance) terminating impedances 1162. On the other hand plot 1204 shows the directivity of the antenna 100 when the outer elements 106 are activated by coupling to the first (high capacitance, low impedance) terminating impedances 1160. When the outer elements are active the directivity at high polar angles (above 70°) increases relative to what is obtained when the outer elements are relatively inactive (coupled to second terminating impedances 1162). Having better gain at high polar angles improves signal quality for objects (e.g., communicating satellites, radar targets) close to the horizon.

For use with antennas of the type shown in FIGS. 1-3 in which the inner and outer quadrifilar elements 110, 106 have the same handedness there is no need to provide for reversing the sense (CW or CCW) in which phase increases, so the first switch layer 1102 of the feed network 1100 would be unnecessary. However for antennas of the type shown in FIGS. 4-5 in which the handedness of the winding of the inner 402 and outer 406 helical elements is opposite and the antenna 400 provides for communication with RHCP or LHCP radio waves, there is a need to reverse the sense (CW or CCW) in which phase increases, and the first switch layer 1102 will be used for this purpose.

Figure 13:
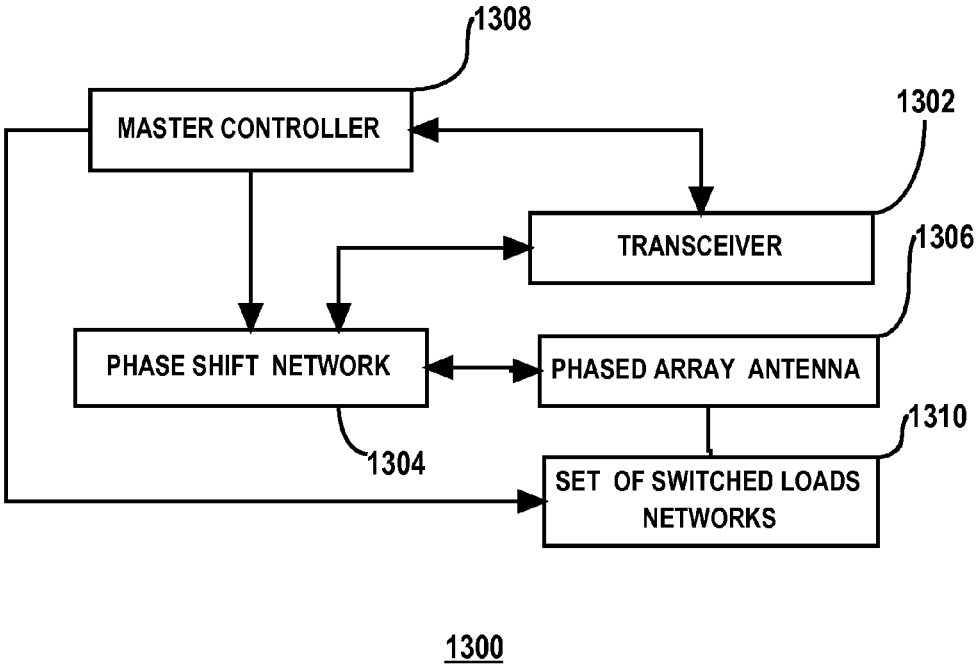
FIG. 13 is a block diagram of a phased array wireless communication device that uses dual quadrifilar antennas with switched loads according to embodiments of the invention.

FIG. 13 is a block diagram of a phased array wireless communication apparatus 1300 that uses multiple dual quadrifilar antennas of the type shown in FIG. 1 with switched loads such as the one shown in FIG. 11 according to embodiments of the invention. The system includes a transceiver 1302 that is used for generating signals to be transmitted and processing received signals. For transmitting the transceiver 1302 can include a signal encoder and a modulator, as is well known in the art. For receiving the transceiver 1302 can include a demodulator and decoder, as is well known in the art. The transceiver 1302 is coupled through a phase shift network 1304 to a phased array antenna 1306. The phase array antenna 1306 comprises a 1-D or preferably a 2-D array of antenna elements. In the present context each 'element' suitably comprises an antenna of the type shown in FIG. 1. The phase shift network 1304 establishes a plurality of signal pathways, to the plurality of elements in the 1-D or 2-D array of elements. Each signal pathway is characterized by a different phase delay in order to obtain a beam steering effect as is well known in the art of phased array antennas. The transceiver 1302 and phase shift network 1304 operate under the control of a master controller 08 to which they are coupled. The master controller 1308 is also coupled to and controls a set of switched load networks 1310. The set of switched load networks 1310 includes the second layer switches 1104 and the terminating impedances 1160, 1162 shown in FIG. 11. A set of the foregoing elements 1104, 1160, 1162 are provided for each antenna element 100 in the phased array antenna 1306. The master controller 1308 controls the set of switched load networks 1310 in coordination with the phase shift network 1304. When the phase shift network 1304 is configured to steer the phased array antenna 1306 to high polar angles (above a predetermined threshold, e.g., 70° for example), the set of switch load networks 1310 will be configured to couple a terminating impedance (e.g., a high capacitance, low impedance load) to the outer elements 106 of the antenna elements 100 which results in the gain of the antenna at high polar angles being improved. On the other hand, when the phase shift network 1304 is configured to steer the phased array antenna 1306 to lower polar angles, the set of switched load networks will be configured to couple a lower capacitance to the outer elements 106 (or to disconnect the outer elements 106), so as restore the antenna gain back to lower polar angles.

Figure 14:
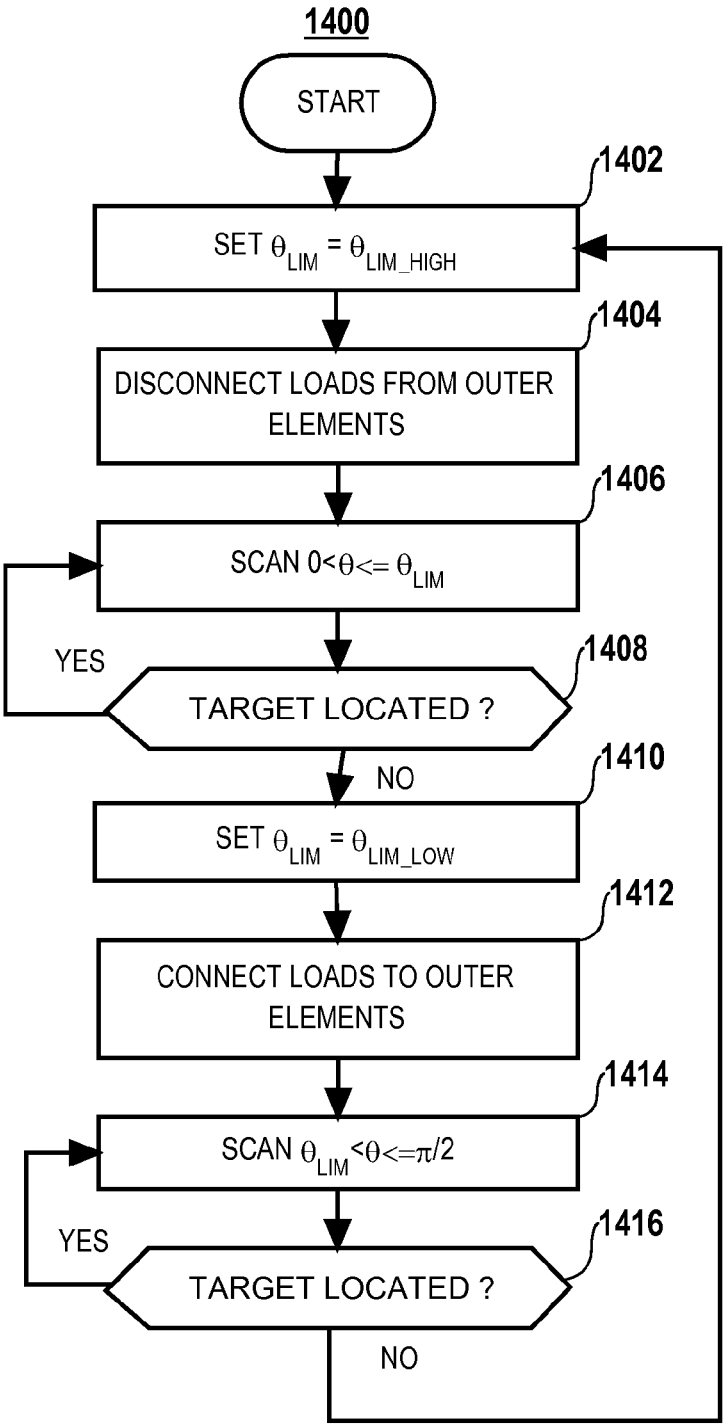
FIG. 14 is a flowchart of a method of operating the phased array wireless communication device shown in FIG. 12.

FIG. 14 is a flowchart of a method 1400 of operating the phased array wireless communication device shown in FIG. 13. In block 1402 a polar angle limit $\Theta_{LIM}$ is set equal to a higher value denoted $\Theta_{LIM_HIGH}$. For the directivity patterns shown in FIG. 12, 80° is an example of an appropriate value of $\Theta_{LIM_HIGH}$. In block 1404 loads are disconnected from the outer antenna elements 106. In the context of FIG. 14 the term 'load' refers to a terminating impedance e.g., 1160 which when coupled to the outer four quadrifilar elements 106 causes the elements to receive energy parasitically from the inner four quadrifilar elements 110 and become active. So, by disconnecting the loads in block 1404 the gain of the antenna 100 is shifted to a lower range of polar angles. In block 1406 a polar angle ($\Theta$) range between zero and $\Theta_{LIM}$ is scanned for a target. Scanning a polar angle range is effected by using the phase shift network 1304. Alternatively the lower bound of range can be a predetermined non-zero value. The method 1400 next proceeds to decision block 1408 the outcome of which depends on whether a target was located in the preceding block 1406. If so, then the process 1400 loops back to block 1406 and continues to scan in the aforementioned range. The target may be tracked in this manner. The target may be a transmitting device (e.g., a satellite, or airplane) or a passive device which is being tracked by radar techniques. If the outcome of block 1408 is negative, then the process 1400 proceeds to decision block 1410 in which $\Theta_{LIM}$ is set to a lower value denoted $\Theta_{LIM_LOW}$. For the directivity patterns shown in FIG. 12, 60° is an example of an appropriate value of $\Theta_{LIM_LOW}$. The purpose of setting $\Theta_{LIM}$ to lower and higher values is to effect a hysteresis in order to avoid excessive connection and disconnection of the outer loads, in the case that an object being tracked is lingering at polar angles in the vicinity of a single polar angle at which one would switch in the loads. In block 1412 the loads are connected to the outer elements 106 using the second switch layer 1104. In block 1414 a polar angle range from $\Theta_{LIM}$ to $\pi/2$ is scanned for a target. Next decision block 1416 tests if the target was located in block 1414. If so then the process 1400 loops back to block 1414 in order to track the target. If, on the other hand, the outcome of decision block 1416 is negative then the process 1400 loops back to block 1402 and proceeds as described above.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

We claim:

1. An antenna system comprising:

a first set of four helical antenna elements;

a second set of four helical antenna elements, wherein said second set of four helical antenna elements is co-axial with said first set of four helical antenna elements wherein said second set of four helical antenna elements is disposed radially outside said first set of four helical antenna elements; and a set of four switched load networks connected respectively to said second set of four helical antenna elements, wherein each of said set of four switched load networks comprises a first switch having a first terminal coupled to one of said second set of four helical elements and a second terminal coupled to a first load of a first predetermined impedance, wherein said first switch is operative to selectively couple said first terminal and said second terminal.

2. The antenna system according to claim 1 wherein said first switch further includes a third terminal coupled to a second load of a second predetermined impedance.

3. The antenna system according to claim 2 wherein said first switch is operable to alternately coupled said first terminal to said second terminal or said third terminal.

4. The antenna system according to claim 1 wherein said first set of four helical antenna elements and said second set of four helical antenna elements are wound in a first common direction.

5. The antenna system according to claim 1 wherein each of said second set of four helical elements have an effective electrical length when coupled to said first load that is between 105% and 120% of an effective electrical length of each of said first set of four helical elements.

6. The antenna system according to claim 1 wherein said first set of four helical antenna elements are wound in a first direction and said second set of four helical antenna elements are wound in a second direction that is opposite to said first direction.

7. The antenna system according to claim 6 further comprising:

a feed network that is adapted to apply a set of four quadrature signals to said first set of four helical elements wherein said four signals are spaced by 90 degrees in phase from each other and said signals are applied to said first set of four helical elements such that phase increases monotonically in 90 degree steps as one proceeds in a circular direction from one helical element to a next helical element; and where said feed network is adapted to switch said circular direction from clockwise to counterclockwise.

8. The antenna system according to claim 7 wherein said feed network comprises:

a balun comprising a balun input port, a balun 0-degree output port and a balun 180 degree output port;

a first 90 degree hybrid comprising a first input port and a second input port;

a first switch matrix adapted to alternately couple said first input port of said first 90 degree hybrid to said balun 0-degree port and a first load resistor and adapted to alternately couple said second input port of said first 90 degree hybrid to said balun 0-degree port and said first load resistor;

a second 90 degree hybrid comprising a third input port and a fourth input port;

a second switch matrix adapted to alternately couple said third input port to said balun 180-degree port and a second load resistor and adapted to alternately couple said fourth input port to said balun 180-degree port and said second load resistor.

* * * * *